US005599116A

United States Patent [19]

Ueda

[11] Patent Number: 5,599,116

[45] Date of Patent: Feb. 4, 1997

[54] PRINTER CARRIAGE MOVEMENT FOR PARTICULAR CHARACTERS

[75] Inventor: Hiroyuki Ueda, Yokohama, Japan

[73] Assignee: Canon Kabushiki Kaisha, Tokyo, Japan

[21] Appl. No.: 171,976

[22] Filed: Dec. 23, 1993

Related U.S. Application Data

[63] Continuation of Ser. No. 20,456, Feb. 22, 1993, abandoned, which is a continuation of Ser. No. 827,916, Jan. 31, 1992, abandoned, which is a continuation of Ser. No. 550,202, Jul. 10, 1990, abandoned, which is a continuation of Ser. No. 290,803, Dec. 23, 1988, abandoned, which is a continuation of Ser. No. 73,306, Jul. 13, 1987, abandoned, which is a continuation of Ser. No. 694,316, Jan. 24, 1985, abandoned.

[30] Foreign Application Priority Data

Jan. 31, 1984 [JP] Japan ..... 59-16283
Jan. 31, 1984 [JP] Japan ..... 59-16284

[51] Int. Cl.[6] ..... B41J 19/18

[52] U.S. Cl. ..... 400/323; 400/279

[58] Field of Search ..... 400/144.2, 323, 400/322, 279

[56] References Cited

U.S. PATENT DOCUMENTS

| | | | |
|---|---|---|---|
| 4,286,889 | 9/1981 | Ebert et al. | 400/320 |
| 4,311,398 | 1/1982 | Gerjets | 400/144.2 |
| 4,388,005 | 6/1983 | Wehking et al. | 400/144.2 |
| 4,410,286 | 10/1983 | Ko et al. | 400/323 |
| 4,493,570 | 1/1985 | Araki . | |

FOREIGN PATENT DOCUMENTS

| | | | |
|---|---|---|---|
| 67291 | 12/1982 | European Pat. Off. | 400/323 |
| 39471 | 3/1983 | Japan | 400/323.1 |
| 215383 | 12/1983 | Japan | 400/323.1 |

*Primary Examiner*—David A. Wiecking
*Attorney, Agent, or Firm*—Fitzpatrick, Cella, Harper & Scinto

[57] ABSTRACT

There is disclosed a printer with a reciprocating printing head for printing in both directions, capable of achieving satisfactory print precision without complicated positioning device. In case of printing certain particular information, if the printing head is moved to the corresponding print position in a particular direction, the printing head is moved further in the particular direction and is then returned to the corresponding print position.

4 Claims, 6 Drawing Sheets

PRINTER CARRIAGE MOVEMENT FOR PARTICULAR CHARACTERS

This application is a continuation of application Ser. No. 08/020,456 filed Feb. 22, 1993, now abandoned, which is a continuation of application Ser. No. 07/827,916 filed Jan. 31, 1992, now abandoned, which is a continuation of application Ser. No. 07/550,202 filed Jul. 10, 1990, now abandoned, which is a continuation of application Ser. No. 07/290,803 filed Dec. 23, 1988, now abandoned, which is a continuation of application Ser. No. 07/073,306 filed Jul. 13, 1987, now abandoned, which is a continuation of application Ser. No. 06/694,316 filed Jan. 24, 1985, now abandoned.

BACKGROUND OF THE INVENTION

1. Field of the Invention

The present invention relates to a printer, and more particularly to an improvement in printers capable of printing in both directions.

2. Description of the Prior Art

Conventionally printers have been developed principally on mechanical technologies and have been designed to perform printing operation from left to right as in the usual typewriter. However, recent development in electronic technologies has introduced electronic control in such printers.

On the other hand, word processors for document editing have been developed with rapidly increasing performances. The printers for such word processors are generally designed to perform so-called two-direction printing, namely printing a line from left to right and then printing a succeeding line from right to left after line feed, in order to improve efficiency in printing an edited document.

However, the printers capable of such two-direction printing are often associated with a drawback, in case of printing, for example, a table T as shown in FIG. 1 on a recording sheet PP, of insufficient alignment of printings of both directions as indicated in the enlarged view M due to insufficient stop precision of printing means such as the printing carriage. An improvement in the stop precision of the printing means for avoiding such drawback will require additional expensive hardware. Consequently the printers capable of two-direction printing for word processors have been inevitably associated with a high manufacturing cost.

SUMMARY OF THE INVENTION

In consideration of the foregoing, an object of the present invention is to provide a printer which is inexpensive and still capable of providing a high print quality.

Another object of the present invention is to provide a printer adapated for use in a printing apparatus or a typewriter capable of achieving a high print quality in two-direction printing without complete stop precision for the printing in both directions.

DETAILED DESCRIPTION OF THE PREFERRED EMBODIMENTS

Now the present invention will be explained in detail by embodiments thereof shown in the attached drawings.

Figure 1:
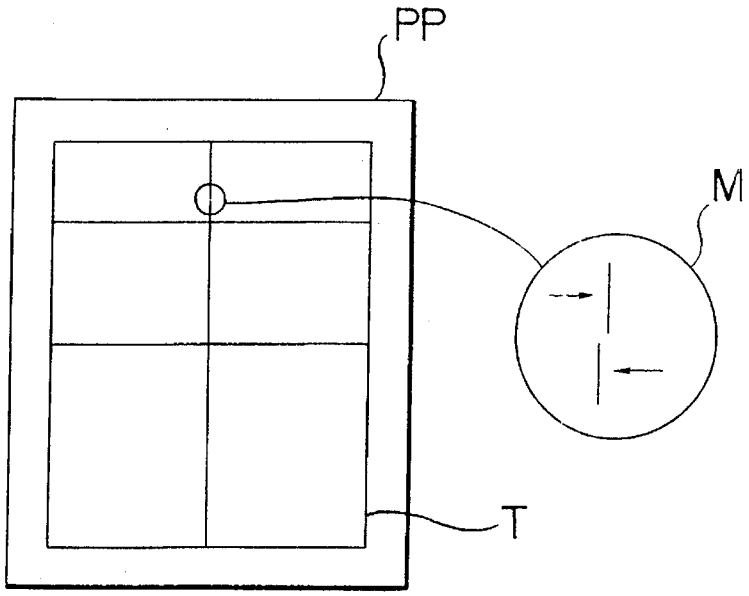
FIG. 1 is a schematic view showing an example of printing with a conventional printer.
Figure 2:
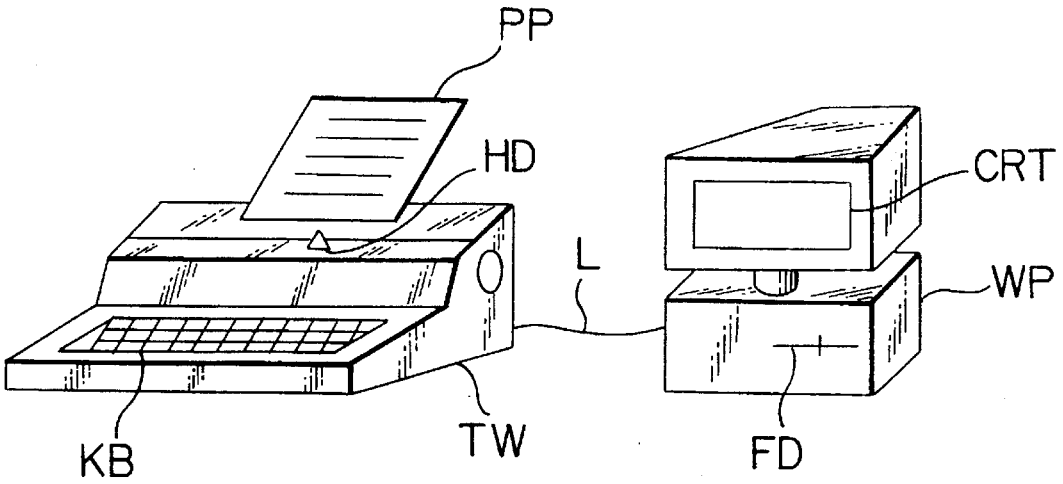
FIG. 2 is a perspective view showing an application of the printer of the present invention.

FIG. 2 shows an application of the printer of the present invention, wherein a printer TW of the present invention is connected with a word processor WP with document editing function through a signal line L. There are also shown a keyboard KB equipped with various keys as input means; a printing sheet PP: a printing head HD of the printer TW; a cathode ray tube device CRT for display; and a floppy disk device FD as memory means.

The operator enters a document through the keyboard KB while watching the cathode ray tube device CRT, then edits the document through the use of the floppy disk device FD etc., and can finally cause the printer TW of the present invention to print the edited document on the printing sheet PP.

The printer TW can perform printing operation in both reciprocating directions by printing a character at a time. The printer TW is equipped with control means to be explained later, for controlling the two-direction printing.

Figure 3:
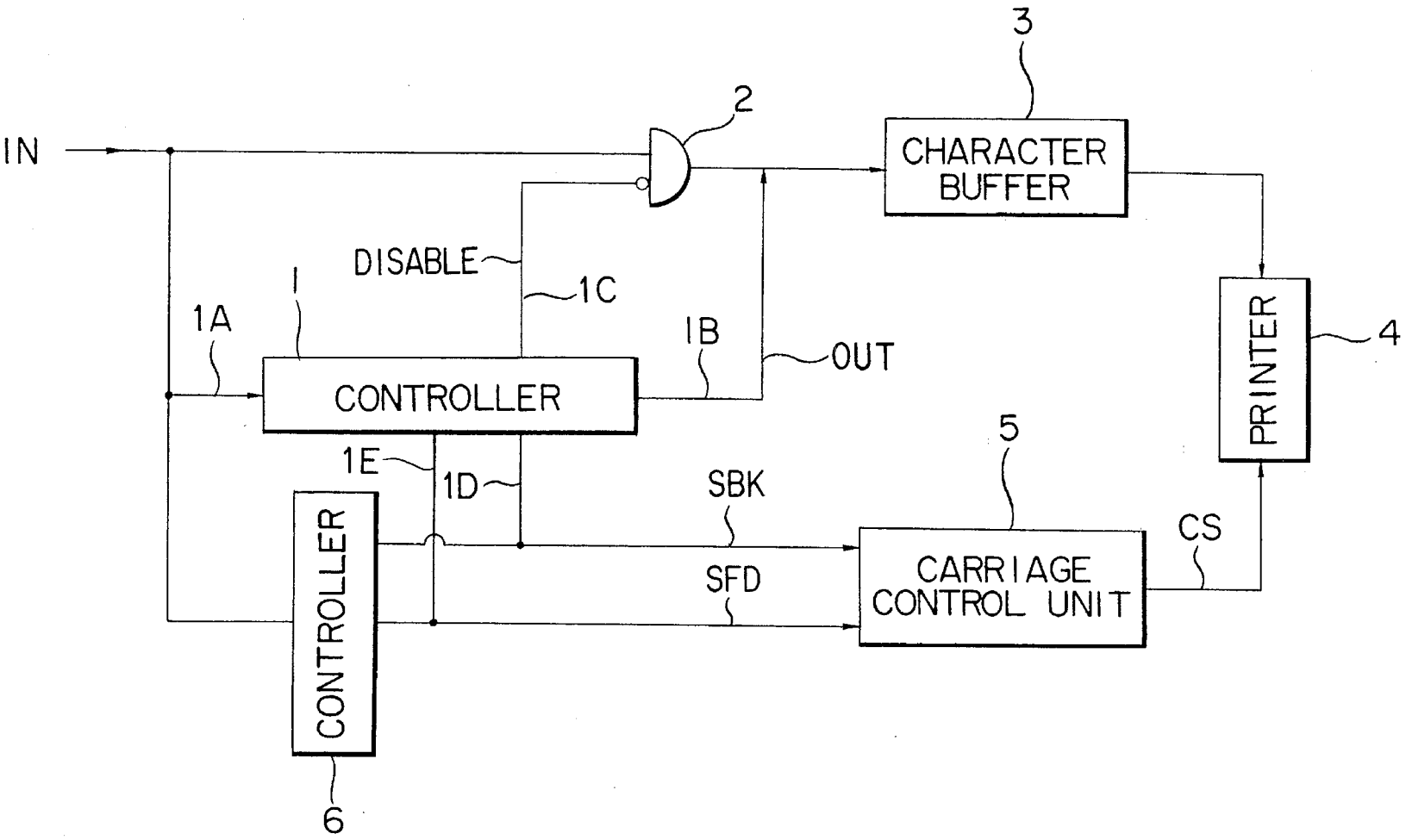
FIG. 3 is a block diagram showing an embodiment of a control unit for use in the printer of the present invention.

FIG. 3 shows an embodiment of the control unit for use in the printer of the present invention.

A controller 1 of the present invention is provided with an input terminal 1A for receiving character codes IN from outside; an output terminal 1B for releasing an output signal OUT at a determined timing when thus received character code IN is a particular character code; a terminal 1C for releasing a gate control signal DISABLE for opening or closing a gate 2 to release the character code IN at a determined timing; and terminals 1D and 1E for releasing instruction signals SBK, SFD to move the carriage, supporting the printing head HD, respectively to left or to right from a determined print position prior to the printing operation in case the entered character code IN is a particular code.

A character buffer 3 temporarily stores the particular character codes from the controller 1 or the general character codes from the gate 2. The character codes stored in the character buffer 3 are supplied, in response to a printing command, to a printer 4 and are printed in the form of corresponding patterns by the activation of the printing head. The printer 4 is capable of printing operation in both directions in reciprocating motion.

A carriage control unit 5 provides instruction to move the carriage of the printer 4 by a determined amount in a desired direction after the character codes are read from the character buffer 3 and printed by the printing head HD. In addition to the above-explained general control, in response to the instruction signal SBK or SFD received from the controller 1 of the present invention, the carriage control unit 5 supplies an instruction signal CS to move the printing head or the carriage prior to the printing operation as will be explained later in more detail. A controller 6 releases a signal to move the carriage to a succeeding print position at a determined time after a character is printed.

Figure 4:
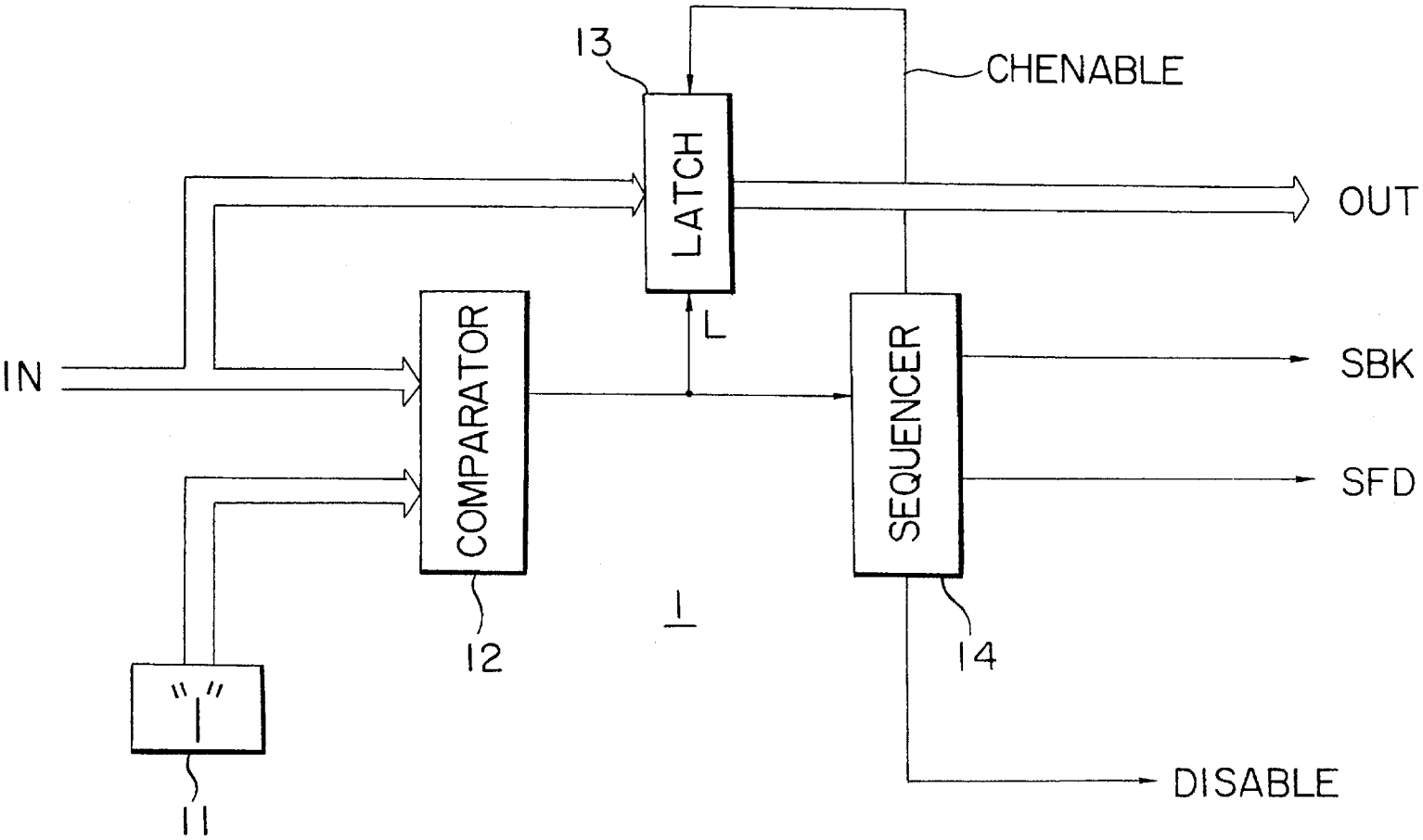
FIG. 4 is a block diagram showing an embodiment of the controller in the printer of the present invention shown in FIG. 3.

FIG. 4 shows the details of the controller 1 shown in FIG. 3.

A read-only memory 11 stores, for example, a character "|" as a particular character according to the present invention. A comparator 12 compares the character code signal IN from outside with the output signal from the read-only memory 11 and supplies the result of comparison as a control signal to a latch 13 and a sequencer 14.

The latch 13 temporarily stores the character codes IN received in succession, and supplies the entered character code, if it is a particular character code of the present invention, to the character buffer 3 shown in FIG. 3, at a timing designated by the sequencer 14.

Figure 6:
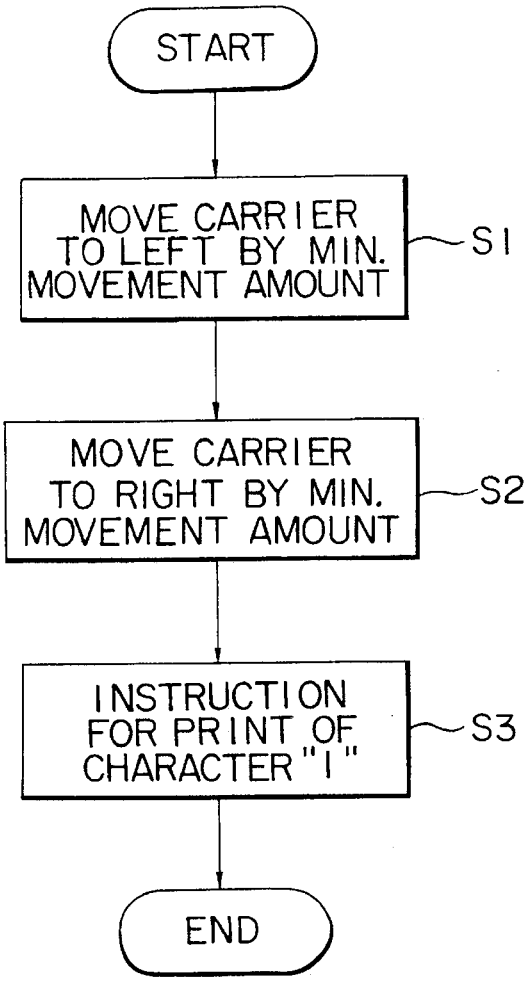
FIG. 6 is a flow chart showing the function of the controller shown in FIG. 4.

The sequencer 14 stores a procedure as shown in FIG. 6 and releases various control signals to be explained later in response to the instruction given by the comparator 12.

When a character code IN is supplied to the input terminal of the comparator 12, it compares said character code IN with the stroke character "|" from the read-only memory 11. If said comparison indicates the absence of coincidence, the sequencer 14 does not release the gate control signal DISABLE whereby the gate 2 shown in FIG. 3 remains in opened state. Consequently the character code IN is supplied to the character buffer 3 and then to the printer 4 in response to a print instruction whereby a normal printing operation is effected.

On the other hand, in case the character code entered to the comparator 12 is the "stroke" which is the particular character code of the present invention, the comparator 12 releases a coincidence output signal to activate the sequencer 14. Also in this state the load terminal L of the latch 13 is rendered active by the coincidence signal from the comparator 12, whereby the character code "stroke" is retained in the latch 13.

The sequencer 14 releases the gate control signal DISABLE to close the gate 2, whereby the supply of the character codes IN from outside to the character buffer 3 is interrupted.

Figure 5:
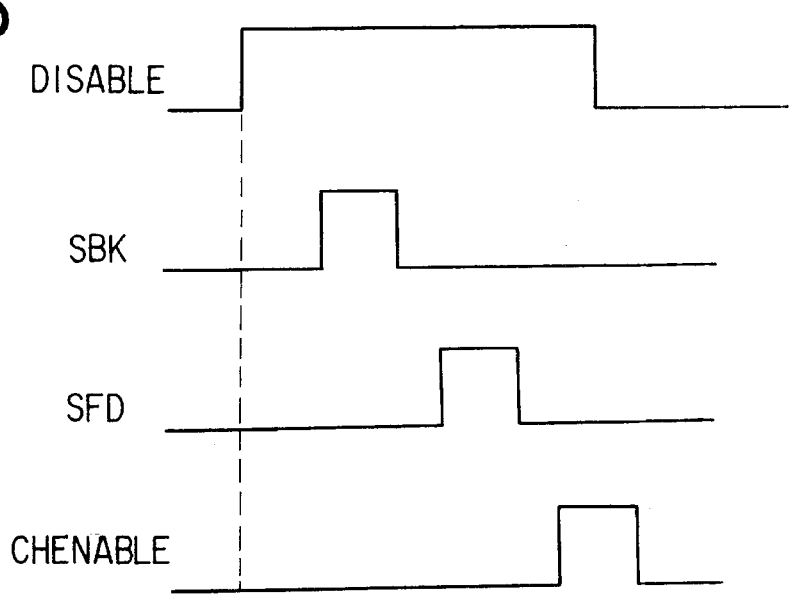
FIG. 5 is a timing chart showing the function of the controller shown in FIG. 4.

Now reference is made to a timing chart shown in FIG. 5 and a flow chart shown in FIG. 6 for further explanation of the above-described functions. It is assumed that the carriage is in a position where a character is to be printed.

At first, in case the comparator 12 releases the coincidence signal, the sequencer 14 is activated and a step S1 is executed. On the other hand, in the absence of coincidence, the signal SBK or SFD is released from the control circuit, after the printing operation of a character, to move the carriage to the print position of a succeeding character. In response to said signal the carriage control unit 5 moves the carriage of the printer 4.

In the step S1, prior to the printing operation, the sequencer 14 supplies the carriage control unit 5 with the signal SBK to move the carriage of the printer 4 by a determined amount to the left. The carriage control unit 5 transmits the instruction to the printer 4, whereby the carriage thereof moves to the left by a minimum amount of movement from the desired print position to which the carriage was already brought.

In a succeeding step S2, the sequencer 14 supplies the carriage control unit 5 with the signal SFD to move the carriage of the printer 4 by a determined amount to the right. The carriage control unit 5 transmits the instruction to the printer 4, whereby the carriage thereof moves in the returning direction, namely to the right, by a minimum amount of movement toward the desired print position.

In a step S3, the sequencer 14 supplies a print instruction signal CHENABLE to the latch 13, which transmits the particular character code of the present invention stored in the latch to the character buffer 3 in response to the signal. Subsequently the character code read from the character buffer 3 is printed in the form of pattern by the printing head HD of the printer 4. Upon completion of the printing operation, the control circuit 6 releases a determined amount of the signal SBK or SFD for moving the carriage of the printer 4 to the print position of a next character, thus activating the carriage control unit 5 to move the carriage of the printer 4.

In this manner the present embodiment is quite easily applicable to the conventional apparatus as it only requires print control means of the present invention in the form of hardware composed of the control unit 1 and the gate 2, in addition to the existent character buffer 3 and carriage control unit 5. Besides the present invention is particularly suitable for use in a daisy wheel printer.

As shown in Tab. 1, the aberration in the print alignment of printers A–E, which was originally in excess of 0.1 mm, is reduced to less than 0.03 mm after improvement according to the present invention. Consequently the printer of the present invention can satisfactorily perform tabulating function for example in word processors, thus making possible a word processing system which is inexpensive and still provides satisfactory performance combined with high print quality.

TABLE 1

| Printer | Before improvement | After improvement |
|---|---|---|
| A | 0.18 (mm) | 0.02 (mm) |
| B | 0.12 | 0.03 |
| C | 0.15 | 0.01 |
| D | 0.19 | 0.02 |
| E | 0.14 | 0.01 |

In the foregoing embodiment the control is applied to the printer in the form of hardware, but it can also be applied to the word processor or it can also be realized in the form of software without change in the obtainable effect.

It is experimentally confirmed that the aforementioned effect can be obtained if the carriage is moved to left and right prior to the printing operation by the minimum amount of movement in case the carriage is moved by a linear stepping motor, or if the carriage is moved by 5 to 10 times of the minimum amount of movement in case the carriage is moved by a servo motor.

Figure 7:
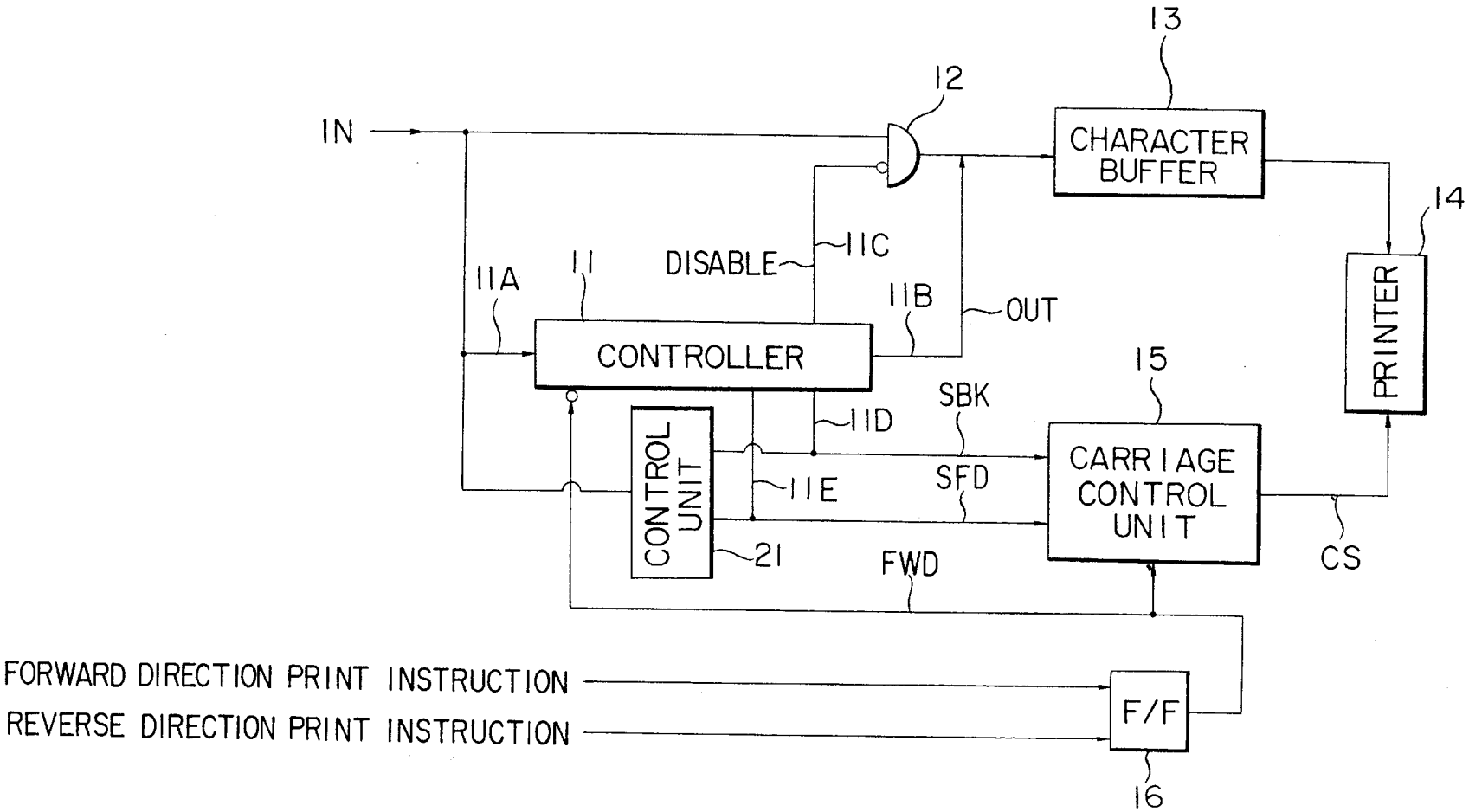
FIG. 7 is a block diagram showing an embodiment of the control unit of the printer of the present invention.

FIG. 7 shows another embodiment of the control unit of the printer of the present invention.

A controller all of the present invention is provided with an input terminal 11A for receiving character codes IN from outside; an output terminal 11B for releasing an output signal OUT at a determined timing when thus received character code IN is a particular character code; a terminal 11C for releasing a gate control signal DISABLE for opening or closing a gate 12 to release the character code IN at a determined timing; and terminals 11D and 11E for releasing instruction signals SBK, SFD to move the carriage, supporting the printing head HD, respectively to the left or to the right from a determined print position prior to the printing operation in case the entered character code IN is a particular code.

A character buffer 13 temporarily stores the particular character code from the controller 11 or the general character codes from the gate 12. The character codes stored in the character buffer 13 are supplied, in response to a printing command, to a printer 14 and are printed in the form of corresponding patterns by the activation of the printing head. The printer 14 is capable of printing operation in both directions in reciprocating motion.

A carriage control unit 15 provides instruction to move the carriage of the printer 14 by a determined amount in a desired direction after the character codes are read from the character buffer 13 and printed by the printing head HD. In addition to the above-explained general control, in response to the instruction signal SBK or SFD received from the controller 11 of the present invention, the carriage control unit 15 supplies an instruction signal CS to move the printing head or the carriage prior to the printing operation as will be explained later in more detail.

A flip-flop 16 releases an output signal FWD, which is either "1" indicating a forward moving direciton of the carriage or "0" indicating a backward moving direction, as an instruction signal to the carriage control unit 15 and the controller 11. The print instruction in the forward or backward direction to the flip-flop 16 is given only once prior to the printing operation in the printer 14, and the moving direction remains the same until a succeeding instruction. A control unit 21 moves the carriage to a next print position at a determined time after the printing operation is completed.

Figure 8:
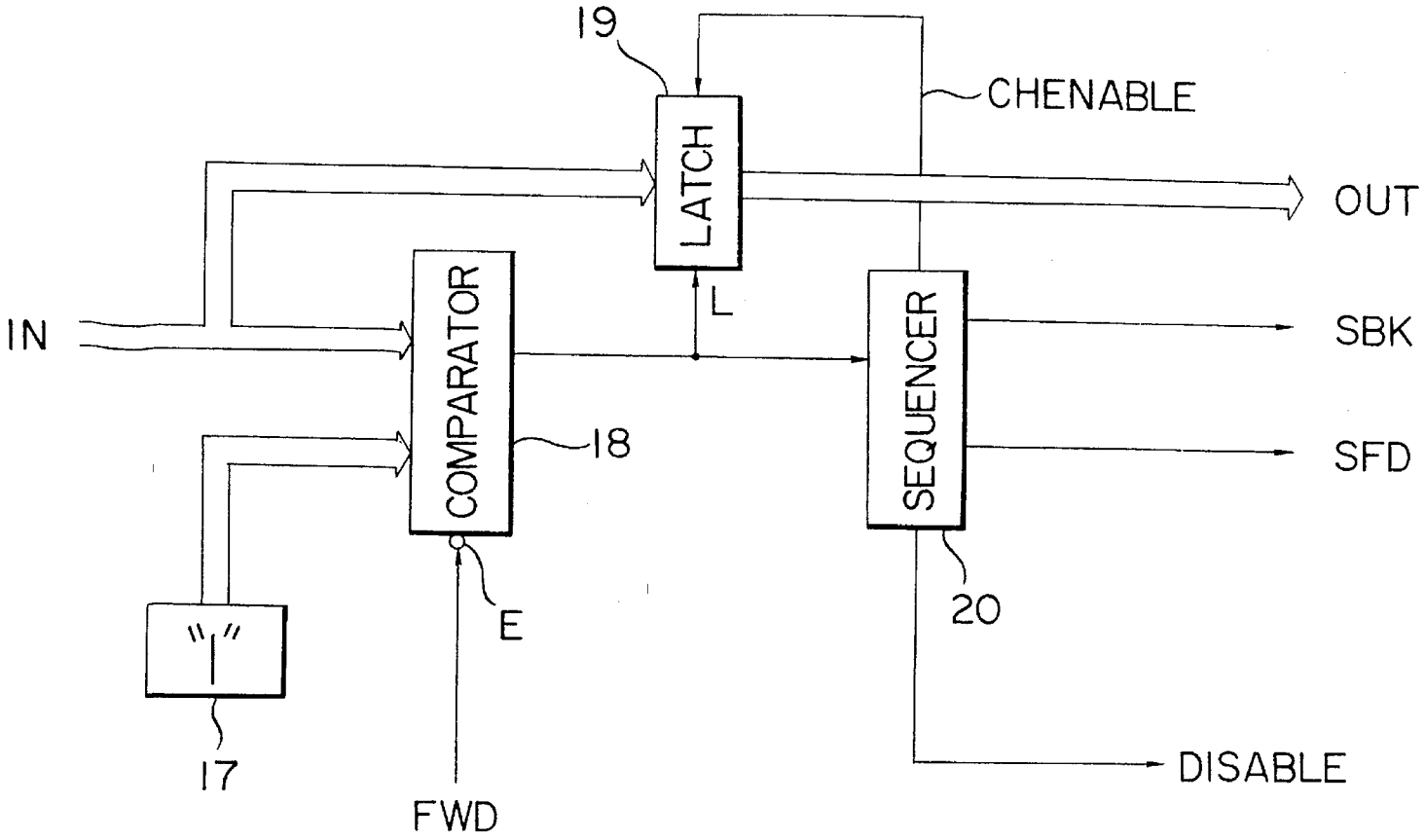
FIG. 8 is a block diagram showing an embodiment of the controller shown in FIG. 7.

FIG. 8 shows in detail the controller 11 shown in FIG. 7.

A read-only memory 17 in advance stores, for example, a stroke character "|" as the particular character code according to the present invention. A comparator 18 is provided with an enable port E for controlling the comparing function, and compares the output signal from the read-only memory 17 with the character codes IN from outside only when the enable port E receives an output signal "0" from the flip-flop 16. The comparator 18 supplies the result of the comparison as a control signal to a latch 19 and a sequencer 20.

The latch 19 temporarily stores the sequentially entered character codes IN and, in case the entered character code IN is the particular character code of the present invention, supplies the particular character code to the character buffer 13 shown in FIG. 7 at a timing determined by the sequencer 20.

The sequencer 20 stores a procedure as shown in FIG. 6 and sequentially release various control signals to be explained later in response to an instruction from the comparator 18.

When a character code IN from outside is supplied to the input terminal of the comparator 18, it compares the character code with the stroke character "|" from the read-only memory 17 only if the enable port E of the comparator is at the level "0", namely if the flip-flop 16 shown in FIG. 7 releases an output signal "0" to move the carriage of the printer 14 in the backward direction for printing by the printing head HD. If coincidence is not found in the comparison, the sequencer 20 does not provide the gate control signal DISABLE, whereby the gate 12 shown in FIG. 7 remains in the opened state to transmit the character code IN to the character buffer 13. The character code is read and supplied to the printer 4 to perform normal printing operation.

On the other hand, in case the character code entered to the comparator 18 is the "stroke" character code which is the particular character code according to the present invention, the comparator 18 releases a coincidence signal to activate the sequencer 20. At the sample time the load terminal L of the latch 19 is rendered active by the coincidence signal from the comparator 18, whereby the "stroke" character code is retained in said latch 19.

The sequencer 20 releases the gate control signal DISABLE whereby the gate 12 is closed to interrupt the supply of the character codes IN from outside to the character buffer 13.

Now reference is made to the timing chart shown in FIG. 5 and the flow chart shown in FIG. 6 for explaining further the above-explained functions. It is assumed that the carriage is at a position where a character is to be printed.

In the aforementioned case of coincidence, in the step S1, the sequencer 20 supplies the carriage control unit 15 with a signal SBK for moving the carriage of the printer 14 by a determined amount to the left prior to the printing operation. This instruction is transmitted by the carriage control unit 5 to the printer 4, whereby the carriage thereof is moved to the left by a minimum amount of movement from the desired print position to which the carriage was moved in advance.

Then, in the step S2, the sequencer 20 supplies the carriage control unit 15 with a signal SFD for moving the carriage of the printer 14 by a determined amount to the right. This instruction is transmitted by the carriage control unit 15 to the printer 14, whereby the carriage thereof is moved by a minimum amount of movement in the returning direction, namely to the right, toward the desired print position.

In the step S3, the sequencer 20 supplies the latch 19 with a print instruction signal CHENABLE whereby the character code of the present invention stored in the latch 19 is supplied to the character buffer 13. The character code is then read from the character buffer 13 and is printed in the form of pattern by the printing head HD by the activation of the printing head HD in the printer 14.

On the other hand, in case the enable port E of the comparator is at the level "1", namely in case the flip-flop 16 shown in FIG. 7 provides an output signal "1" for moving the carriage of the printer 14 in the forward direction for printing by the printing head HD, the comparator 18 does not perform the aforementioned comparison of two signals. In this state, therefore, the sequencer 20 is not activated and the character codes IN from outside are sequentially stored in the character buffer 13. After a character read from the character buffer 13 is printed by the printer 14, the carriage control unit 15 moves the carriage of the printer 14 by a determined amount in response to an instruction from the control unit 21.

The above-described functions allow reduction of aberration in the print alignment, in case of printing in the backward direction, prior to the printing of a particular character.

In this manner the present embodiment is quite easily applicable to the conventional apparatus as it only requires print control means of the present invention in the form of hardware composed of the controller 11 and the gate 12, in addition to the existent character buffer 13 and the carriage control unit 15. Besides the present invention is particularly suitable for use in a daisy wheel printer.

In the foregoing embodiment it is assumed that the comparator 18 performs the comparison when the enable port E is at the level "0", but it is also possible to cause the comparator 18 to perform the comparing operation when the enable port E is at the level "1", namely when the flip-flop 16 shown in FIG. 7 releases an output signal "1" to move the carriage of the printer 14 in the forward direction.

In the foregoing embodiment the control is applied to the printer in the form of hardware, but it can also be applied to the word processor or it can also be realized in the form of software without change in the obtainable effect.

As explained in the foregoing, the printer of the present invention is capable of printing operation in both directions of reciprocating motion but prints a character after the aberration in the print alignment is eliminated in case of printing a particular character in a predetermined moving direction, whereby the print of a high print quality can be obtained inexpensively for example in tabulation requiring particularly precise print alignment.

What I claim is:

1. A printer comprising:

printing means capable of performing a printing operation;

a carriage having said printing means mounted thereon, capable of changing its movement direction from a forward direction to a backward direction or from a backward direction to a forward direction along each line of printing;

print control means for moving said carriage in both of said directions and for causing said printing means to effect printing in each direction;

discriminating means for discriminating whether next information to be printed, input by said input means, is particular information, wherein the next information being printed is adjacent to previous information to be printed; and instruction means arranged in said print control means, responsive to a discrimination by said discriminating means that said particular information is to be printed, for controlling movement of said carriage in a direction, and after moving said carriage to a determined print position, controlling said carriage to move by a minimum amount of movement in a direction from said determined print position and to return said carriage by the minimum amount of movement to said determined print position prior to the printing of said particular information, and then to instruct the printing of said particular information, and then still further to move said carriage in said direction, and responsive to a discrimination by said discriminating means that said information to be printed is not particular information, for controlling movement of said carriage in a direction, to instruct the printing of said information to be printed, and then to move said carriage to a determined print position, and then still further to move said carriage in said direction.

2. A printer according to claim 1, wherein said discriminating means discriminates ruled line information.

3. A printer according to claim 1, further comprising memory means for storing said particular information.

4. A printer according to claim 1, wherein said instruction means arranged in said print control means, responsive to a discrimination by said discriminating means that said particular information is to be printed, controls movement of said carriage, to move said carriage to a determined print position, so that said carriage moves further in a direction from said determined print position and returns said carriage to said determined print position prior to the printing of said particular information, and then to instruct the printing of said particular information without moving said carriage through every permissible position on a line for printing at a plurality of print positions on the line.

* * * * *

UNITED STATES PATENT AND TRADEMARK OFFICE

CERTIFICATE OF CORRECTION

PATENT NO. : 5,599,116 Page 1 of 3

DATED : February 4, 1997

INVENTOR(S) : HIROYUKI UEDA

It is certified that error appears in the above-indentified patent and that said Letters Patent is hereby corrected as shown below:

COLUMN 1:

Line 43, "Consequently" should read --Consequently,--.

COLUMN 2:

Line 23, "PP:" should read --PP;--.

UNITED STATES PATENT AND TRADEMARK OFFICE

CERTIFICATE OF CORRECTION

PATENT NO. : 5,599,116 Page 2 of 3

DATED : February 4, 1997

INVENTOR(S) : HIROYUKI UEDA

It is certified that error appears in the above-indentified patent and that said Letters Patent is hereby corrected as shown below:

COLUMN 3:

Line 27, "Consequently" should read --Consequently,--.

COLUMN 4:

Line 8, "Subsequently" should read --Subsequently,--.

Line 26, "Consequently" should read --Consequently,--.

Line 55, "all" should read --11--.

UNITED STATES PATENT AND TRADEMARK OFFICE

CERTIFICATE OF CORRECTION

PATENT NO. : 5,599,116 Page 3 of 3

DATED : February 4, 1997

INVENTOR(S) : HIROYUKI UEDA

It is certified that error appears in the above-indentified patent and that said Letters Patent is hereby corrected as shown below:

COLUMN 5:

Line 46, "release" should read --releases--.

Signed and Sealed this

Nineteenth Day of August, 1997

Bruce Lehman

*Attest:*

BRUCE LEHMAN

*Attesting Officer*

*Commissioner of Patents and Trademarks*